US007699194B2

(12) United States Patent
Cortese

(10) Patent No.: US 7,699,194 B2
(45) Date of Patent: Apr. 20, 2010

(54) METHOD AND MACHINE FOR TREATING TEXTILE ARTICLES

(75) Inventor: Carmelo Angelo Cortese, Sasso Marconi (IT)

(73) Assignee: Cortese S.p.A., Bologna (IT)

( * ) Notice: Subject to any disclaimer, the term of this patent is extended or adjusted under 35 U.S.C. 154(b) by 1287 days.

(21) Appl. No.: 10/545,353

(22) PCT Filed: Mar. 5, 2004

(86) PCT No.: PCT/IT2004/000111

§ 371 (c)(1),
(2), (4) Date: Aug. 11, 2005

(87) PCT Pub. No.: WO2004/081274

PCT Pub. Date: Sep. 23, 2004

(65) Prior Publication Data

US 2006/0131353 A1 Jun. 22, 2006

(30) Foreign Application Priority Data

Mar. 14, 2003 (IT) ..... BO03A00142

(51) Int. Cl.
*D06C 5/00* (2006.01)

(52) U.S. Cl. ..... 223/76; 223/75

(58) Field of Classification Search ..... 223/75–77, 223/1; 28/295; 198/468.4

See application file for complete search history.

(56) References Cited

U.S. PATENT DOCUMENTS

| | | | | |
|---|---|---|---|---|
| 3,520,262 | A * | 7/1970 | Matthews et al. | 112/470.36 |
| 3,686,726 | A * | 8/1972 | Glaze et al. | 28/154 |
| 4,166,556 | A * | 9/1979 | Annas, Sr. | 223/112 |
| 4,658,995 | A | 4/1987 | Teague | |
| 5,709,326 | A | 1/1998 | Fröhlich | |
| 6,648,190 | B1 * | 11/2003 | Manini | 223/76 |

* cited by examiner

*Primary Examiner*—Shaun R Hurley
*Assistant Examiner*—Andrew W Sutton
(74) *Attorney, Agent, or Firm*—McGlew and Tuttle, P.C.

(57) ABSTRACT

Textile articles to be treated are fed on to shapes fitted to supporting members. Gliding independently each other on a platform of the boarding or semi-boarding machine, and positioned in mutual contact at respective sides along a polygonal pathway defined by a guiding device. The supporting members are transported in step along the polygonal pathway, by the engagement with a towing device acting independently at each linear stretch of the polygonal pathway, so that in each step at least one position at the concurrence of two linear stretches of the polygonal pathway is maintained unoccupied. At least one of the supporting members, on which the textile articles to be treated are fed, is arranged in a halt position upstream from a semi-boarding station and then is moved to take the shapes into the semi-boarding station. After the semi-boarding treatment, this supporting member is transferred to a station where the textile articles, treated, are extracted from the shapes.

14 Claims, 2 Drawing Sheets

METHOD AND MACHINE FOR TREATING TEXTILE ARTICLES

TECHNICAL FIELD

The following invention regards a method and a machine for treating textile articles, in particular socks, for example for boarding or semi-boarding these articles.

BACKGROUND ART

It is known that during production the above mentioned textile products undergo such treatments as to give them a desired aspect. In particular, socks undergo a treatment of semi-boarding or of thermal boarding. In order to perform this semi-boarding, the articles are fed on to and held taut by special shapes and then subject to a pressing treatment, in some cases preceded by a steaming treatment of the articles to be treated. Sometimes the semi-boarding treatment is combined with a boarding treatment by means of pressurised steam.

Automatic boarding or semi-boarding machines currently known are substantially composed of a turntable, around the edge of which are positioned fitting shapes, which the articles are fed on to and by which they are held taut. The rotation of the turntable takes the articles fed on to the shapes to a steaming station and successively to a semi-boarding station in which suitable pressing means operate. In a different version of the machine the semi-boarding treatment is accomplished by means of boarding with pressurised steam, provided by a suitable autoclave, and by means of a successive drying phase with hot air. The articles are then extracted from the boarding shapes and sent onto the subsequent packaging phases.

Boarding shapes are preferably solid shapes of a metallic material, most commonly aluminium, and shaping at the toe the foot contour.

The fitting of the boarding shapes in a position rigidly defined on the turntable of the semi-boarding machine considerably limits the operation of the machine itself. In fact all shapes move simultaneously and in the same step, which is defined by the loading phase of the articles on to the shapes. Normally the turntable proceeds in a single or multiple step in the machines that realize the semi-boarding phase by means of pressing, while in the machines provided with boarding by pressurised steam the turntable proceeds in double step at least, i.e. moving in each step two shapes to each station, in order to obtain a sufficient stay of the articles in the autoclave.

This functional rigidity is in contrast with the current productive requests, concerning the maximum flexibility for the different textile articles to be treated, and can affect the ergonomics of the machine, as the operator has to accomplish the loading of two different shapes.

Moreover the known boarding or semi-boarding machines show a complex and expensive structure, caused by the need to realise the different operational phases in positions where operational members are moved rotationally. The circular structure of the turntable also produces a considerable space occupied and, as a consequence, limits the number of shapes.

DISCLOSURE OF INVENTION

The aim of the present invention is to resolve the above-mentioned drawbacks by devising a method which allows to realise in an effective way the boarding or semi-boarding of textile articles, in particular socks, assuring likewise a real functional versatility.

Within this scope, it is a further aim of the present invention to provide a machine for treating textile articles which is able to assure great ergonimics.

A further aim of the invention is to provide a machine of real constructive simplicity, reliable operation and limited space occupied.

The above-mentioned objectives can be achieved, according to this present invention, by the method for treating textile articles, characterized in that it comprises the phases of:

(a). feeding the textile articles to be treated on to shapes fitted on supporting members, sliding independently each other on a platform bound to the fixed structure of the boarding or semi-boarding machine and positioned in mutual contact by respective sides along a polygonal pathway defined by guiding means associated with said platform;

(b). transporting in step said supporting members along said polygonal pathway, by engagement with towing means acting independently, in suitable relation of phase, at each linear stretch of said polygonal pathway, so that in each step at least one position at the concurrence of two linear stretches of said polygonal pathway remains unoccupied;

(c). arranging at least one of said supporting members for said shapes, on to which said textile articles to be treated are fed, in a halt position upstream from a semi-boarding station along a stretch of said polygonal pathway;

(d). moving said supporting member, along said stretch of the polygonal pathway, so as to take said shapes into said semi-boarding station, in order to accomplish the treatment of said textile articles;

(e). transferring said supporting member, when the treatment is completed, to a station for the extraction of said textile articles, treated, from said shapes.

BRIEF DESCRIPTION OF DRAWINGS

Description details of the invention shall be further evident in the illustrations of a preferred type of a machine treating textile articles, in the guideline drawings attached and wherein.

BEST MODE FOR CARRYING OUT THE INVENTION

Figure 1:
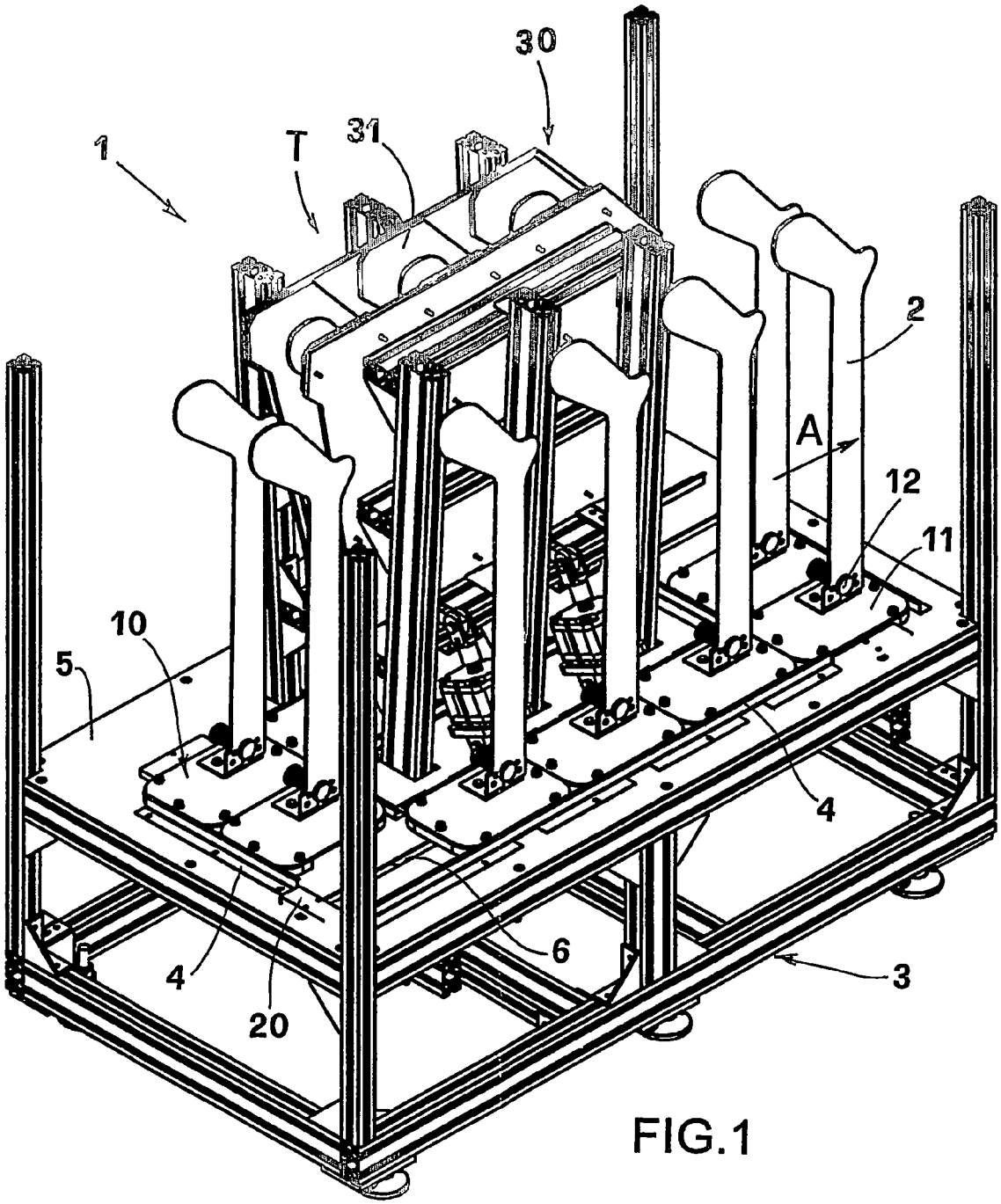
FIG. 1 illustrates a perspective view of a machine for semi-boarding textile articles, functioning according to the method in object.
Figure 2:
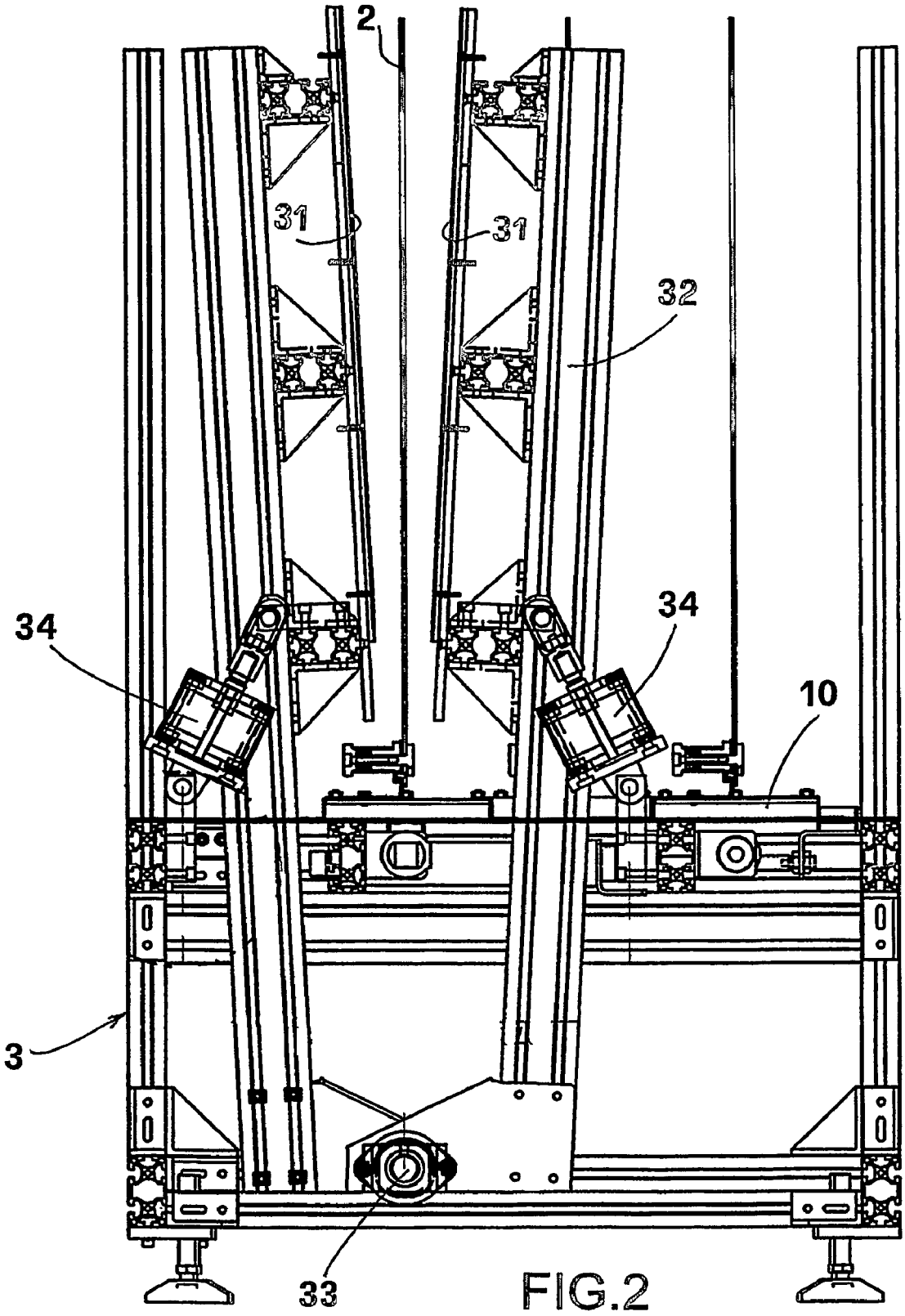
FIG. 2 illustrates a sectional view by a vertical transversal plane.

With reference to such FIG. 1 refers to the machine for semi-boarding textile articles, such as, in particular, socks and similar. The textile articles to be semi-boarded are fed on to respective shapes 2. The semi-boarding machine carries the shapes 2 along a polygonal pathway, shaping in particular a rectangular outline. Along this polygonal pathway is singularly carried in step a set of supporting members 10, on which the shapes 2 are fixed in a not movable way, by means of suitable fitting means 12. The supporting members 10 of the shapes 2 are composed by a plate 11 of substantially rectangular shape, having sides parallel to the sides of the said polygonal pathway.

The plates 11 glide on the platform 5 defined by the fitted structure 3 of the machine. In the case illustrated the supporting members 10 carry respective shapes 2 suitably shaped in order to define the foot of the socks.

The supporting members 10 are guided along each stretch of the polygonal pathway by guiding means 4 constituted by suitable structural shapes fixed in pairs on the platform 5, so as to engage the sides of the plates 11.

At each stretch of the polygonal pathway, towing means 20, constituted by respective transversal pushers, act on the supporting members 10. The pushers 20 are bound to drive members which, in the case illustrated, are positioned under the platform 5 and are connected to the same pushers through openings 6 made on the platform 5. These drive members, which are not drawn in the figures, are constituted, for example, by respective toothed belt conveyors, operated in step, in alternate motion, by suitable motor drives upon control of electronical means.

Obviously it is possible to drive the pushers 20 by means of members external to the supporting members 10, for example positioned sideways from each linear stretch of the polygonal pathway.

The single step operated by the pushers 20 obviously corresponds to the longitudinal dimension of the supporting members 10 in the direction of the proceeding linear stretch along the polygonal pathway. As it is specified in the following paragraphs, the pusher 20 can be operated independently along each linear stretch of the polygonal pathway, in single or multiple step, i.e. double or triple, according to the specific requirements of the different products.

Practically, the supporting members 10 are taken in single or multiple step, one after another and in mutual contact at the respective sides, along a first stretch of the polygonal pathway to be realised, being the shapes 2 arranged aligned each other on a longitudinal vertical plane with reference to the proceeding direction. The station where the textile articles are loaded on the shapes 2 is positioned at this first stretch of the polygonal pathway. It is also possible that, at the loading station, the textile articles are fed on to the shapes 2 by hand or automatically by means of a suitable loading robot.

The shapes 2, carried by the supporting members 10 sliding on the platform 5 and guided by the slide 4, proceed in single or multiple step, pushed by the pusher 20, in the direction indicated by the arrow A, till the end of the said first stretch of the polygonal pathway. At the end of this first stretch, the supporting members 10 are transferred in step, one after another, to a second stretch of the polygonal pathway, along a direction perpendicular to the previous one, being the shapes 2 positioned on a vertical plane parallel to the proceeding direction. Along this second stretch of the polygonal pathway it is advantageaous and possible to have a station for the stretching out and the alignment of the textile articles fed on to the shapes, so that the same articles can be prepared in a predetermined position on the shapes.

It is important to notice that, in order to allow the proceeding in step of the shapes 2 along the first linear stretch of the polygonal pathway, it is necessary that at least one position at the concurrence of the said first and second linear stretch of the pathway is initially unoccupied, being the said position occupied at the end of the proceeding phase by the supporting member 10 bearing the first shape 2 of the row of shapes moved by the pusher 20 along the first linear stretch of the pathway.

Obviously, at each stroke of the pusher 20, all shapes 2 of the said row of shapes proceed by one step along the first linear stretch of the pathway and the first shape 2 of the row fills the said unoccupied position.

Similarly, in order to allow the successive proceeding in step of the shapes 2 along the second linear stretch of the pathway, it is necessary that the position at the concurrence of the second and third linear stretch of the pathway is cleared. This proceeding of the shapes 2 along the second stretch of the pathway clears again, in each step, the said position at the concurrence of the first and the second linear stretch of the pathway, so that a new in step proceeding phase is allowed to the shapes 2 along the first linear stretch of the pathway and a successive sock to be semi-boarded can be loaded.

At least two positions at the concurrence of respective linear stretches of the polygonal pathway are maintained preferably unoccupied, so that the supporting members 10 bearing the shapes 2 can be moved concurrently, in an independent way, along two opposite parallel linear stretches of the polygonal pathway, so as to double the machine speed.

The shapes 2 are transferred in step, one after another, on the third stretch of the polygonal pathway, which is parallel to the first stretch. Along this third stretch of the polygonal pathway a semi-boarding station S is defined, in which suitable pressing means 30 operate. Upstream from the semi-boarding station S can be usefully positioned a station for the steaming of the textile articles fed on to the shapes 2.

The pressing means 30 are constituted by a couple of opposing plates 31, carried by respective oscillating frames 32, hinged lowerly on longitudinal coaxial pivots 33. The frames 32 are movable upon operation of respective actuators 34, so that the pressing plates 31 can be closed on the shapes 2, transferred in step into the station S. This solution allows a wider swing at the upper part of the shapes 2, so that a possible swing of the top of the same shapes occurs, even though by a very limited angle. In particular the semi-boarding machine presents, at the third stretch of the polygonal pathway, parallel to the first stretch where the loading station is, a multiple semi-boarding station, constituted by a plurality of pairs of pressing plates 31, opposing each other, positioned parallel, each being able to receive a pair of shapes 2. In the case illustrated as example the multiple semi-boarding station comprises three pairs of pressing plates 31, operated simultaneously in opened and closed position by the oscillating frames 32.

Proceeding in step through the semi-boarding station, the shapes 2 successively engage the said pairs of pressing plates 31 and so undergo three successive pressing treatments.

On leaving the semi.boarding station, the supporting members 10 bearing the shapes 2 are transferred again in perpendicular direction, one after another, along a forth stretch of the polygonal pathway, till they reach again the initial position of the first stretch of the pathway. At this first stretch of the polygonal pathway, upstream from the loading station, known extracting means accomplish the single or multiple extraction of the textile articles from the shapes 2.

So the described method reaches the aim to accomplish in an effective way the treating of textile articles, such as sock and the like, by means of a compact machine, which occupies a very limited space and is able to assure great ergonomics.

A special feature of the invention lies in the fact that the cited result is obtained by means of a machine, characterized by great constructive and functional simplicity and offering a real versatility of use.

This is obtained in particular thanks to the fact that the shapes 2 bearing the textile articles are fitted to supporting members 10 which are mobile independently each other along a polygonal pathway, in practise a rectangular one, defined by linear stretches, at which towing means 20 for the supporting means 10 act, being operated independently in suitable phase relation. In particular the different operational stations are positioned along two opposite parallel linear stretches, so that the machine mainly shows a longitudinal extent.

This allows to suit the machine in a substantially modular way to the specific requirements of the various manufacturers of textile articles. In fact it is possible to vary the proceeding step length of the shapes in a differentiated way along the different linear stretches of the polygonal pathway, and to place along these linear stretches the operational stations specifically required for the treatment of the different types of textile articles.

By way of example, it is possible to realise the proceeding of the shapes 2 in single step, as it is described previously, or in multiple step, for instance in double step, i.e. by moving the shapes 2 in a step equal to twice as much as the longitudinal dimension of the supporting members 10 in the direction of the proceeding linear stretch along the polygonal pathway.

In this second case, in the loading station two shapes 2, fitted to respective supporting members 10, halt and are successively loaded; these shapes 2 meet successively a double semi-boarding station, for a double pressing time, and a double extraction station, i.e. a station provided with two parallel extracting devices.

In order to operate in double step it is obviously necessary that at least two subsequent positions, at the concurrence of the respective linear stretch of the polygonal pathway with the following stretch, are initially unoccupied.

The semi-boarding station can be single or multiple, as described previously. It is also possible to realise the accumulation of a certain number of shapes 2 upstream from the semi-boarding station and then to transfer simultaneously the accumulated shapes into the multiple semi-boarding station. Obviously, during the accumulation phase, the shapes 2 are moved one after another in single step; when the desired number of accumulated shapes 2 is reached, for example two or more, upstream from the semi-boarding station, a long stroke of the pushers is operated in order to take simultaneously all the accumulated shapes into the multiple semi-boarding station.

It is also possible to differentiate the step defining the proceeding of the shapes along the different linear stretches of the polygonal pathway, for example proceeding in single step at the loading station, for greater ergonomics, and realising the cited multiple transfer of the shapes to the semi-boarding station.

Alternatively to the semi-boarding through pressing means, the semi-boarding machine can be provided with a station of thermal boarding by means of pressurised steam, single or multiple too. The boarding phase is advantageously realised by means of one or more autoclaves, each constituted by a pair of shells bound to respective oscillating frames, hinged lowerly on coaxial pivots and apt to be close hermetically by means of suitable connecting elements.

The steam boarding treatment is generally followed by a drying phase, preferably in a multiple drying station which can receive even a huge number of shapes.

It is also possible that after the said drying phase a pressing phase is realised.

According to a further embodiment it is possible to realise the treatment of the textile articles by means of infrared ray thermal panels. This treatment is specifically meant to textiles not dyed yet.

In certain cases the required treatment can be limited only to the phase of drying.

An essential advantage of the machine in object is constituted by the fact that the shapes are moved along the said polygonal pathway, composed of linear stretches, producing an evident structural and functional simplification in comparison with the turning motion characterising the traditional machines, and resulting in an appreciable reduction of the space occupied. The machine can also be provided with any number of shapes, according to the specific needs of use.

Materials adopted for the actual realization of the invention, as well as their shapes and sizes, can be various, depending on the requirements. All single features disclosed with reference to general specifications or to particular embodiments can be present themselves or substitute features in other modes for carrying out the invention.

Where technical features mentioned in any claim are followed by reference signs, those reference signs have been included for the sole purpose of increasing the intelligibility of the claims and accordingly, such reference signs do not have any limiting effect on the scope of each element identified by way of example by such reference signs.

The invention claimed is:

1. A method for treating textile articles, the method comprising the steps of:

feeding the textile articles to be treated on to shapes fitted on supporting members, sliding independently each other on a platform bound to the fixed structure of a boarding or semi-boarding machine, and positioned in mutual contact by respective sides along a polygonal pathway defined by guiding means associated with said platform;

transporting in step said supporting members along said polygonal pathway, by the engagement with towing means acting independently, in suitable relation of phase, at each linear stretch of said polygonal pathway, so that in each step at least one position at the concurrence of two linear stretches of said polygonal pathway remains unoccupied;

arranging at least one of said supporting members for said shapes, on to which said textile articles to be treated are fed, in a halt position upstream from a semi-boarding station along a stretch of said polygonal pathway;

moving said supporting member, along said stretch of the polygonal pathway, so as to take said shapes inside said semi-boarding station, in order to accomplish the treatment of said textile articles;

transferring said supporting member, when the semi-boarding treatment is completed, to a station for the extraction of said textile articles, treated, from said shapes, wherein a set of supporting members for said shapes, on to which said textile articles to be treated are fed, are arranged in an accumulation position upstream from a multiple semi-boarding station, provided with a corresponding set of pressing means, and said set of supporting members is simultaneously moved along said stretch of the polygonal pathway, in order to take said shapes to meet said pressing means so that the semi-boarding treatment of said textile articles is accomplished.

2. A method according to claim 1, wherein said supporting members are transported in step along a polygonal pathway shaping two opposite parallel linear stretches, at which, respectively, said textile articles to be treated are fed on to said shapes fitted to said supporting members, in a loading station, and said semi-boarding treatment of the same textile articles is accomplished, in said semi-boarding station.

3. A method according to claim 2, wherein along said opposite parallel linear stretches of the polygonal pathway said shapes are arranged aligned each other on a vertical plane, longitudinal with reference to the proceeding direction.

4. A method according to claim 1, wherein in each step at least two positions, each positioned respectively at the concurrence of respective linear stretches of said polygonal pathway, are maintained unoccupied, in order to simultaneously move said supporting members, independently, along two opposite parallel linear stretches of said polygonal pathway.

5. A machine for treating textile articles, the machine comprising:

a loading station, where the textile articles to be treated are fed on to shapes fitted to supporting members, sliding independently each other on a platform bound to the fixed structure of the machine and positioned in mutual contact at respective sides along a polygonal pathway defined by guiding means associated with said platform;

in step towing means for said supporting members, acting independently, in suitable relation of phase, at each linear stretch of said polygonal pathway, so that in each step at least one position at the concurrence of two linear stretches of said polygonal pathway remains unoccupied;

a semi-boarding station positioned along a stretch of the said polygonal pathway and is able to receive said shapes fitted to said supporting members, in order to accomplish the treatment of said textile articles;

a station for extracting the said textile articles, treated, from said shapes, wherein said semi-boarding station comprises a pressing means including at least one pair of opposing plates, taken by respective frames hinged lowerly on axes longitudinal to the proceeding direction of said shapes and oscillating by means of respective actuators, in order to take said plates to close on said shapes transferred in step to said semi-boarding station.

6. A machine according to claim 5, wherein said polygonal pathway comprises two opposite parallel linear stretches, at which respectively said textile articles to be treated are fed on to said shapes fitted to said supporting members, in said loading station, and said semi-boarding treatment of the same textile articles is accomplished, in the semi-boarding station, along said opposite parallel linear stretches of the polygonal pathway, said shapes being arranged aligned each other on a vertical plane longitudinal to the proceeding direction.

7. A method for treating textile articles, the method comprising the steps of:

feeding the textile articles to be treated on to shapes fitted on supporting members, sliding independently each other on a platform bound to the fixed structure of a boarding or semi-boarding machine, and positioned in mutual contact by respective sides along a polygonal pathway defined by guiding means associated with said platform;

transporting in step said supporting member along said polygonal pathway, by the engagement with towing means acting independently, in suitable relation of phase, at each linear stretch of said polygonal pathway, so that in each step at least one position at the concurrence of two linear stretches of said polygonal pathway remains unoccupied;

arranging at least one of said supporting members for said shapes, on to which said textile articles to be treated are fed, in a halt position upstream from a semi-boarding station along a stretch of said polygonal pathway;

moving said supporting member, along said stretch of the polygonal pathway, so as to take said shapes inside said semi-boarding station, in order to accomplish the treatment of said textile articles;

transferring said supporting member, when the semi-boarding treatment is completed, to a station for the extraction of said textile articles, treated, from said shapes, wherein said semi-boarding treatment of the textile articles is accomplished, in said semi-boarding station, by means of a pressing means oscillating, hinged lowerly on axes longitudinal to the proceeding direction of the said shapes.

8. A method for treating textile articles, the method comprising the steps of:

feeding the textile articles to be treated on to shapes fitted on supporting members, sliding independently each other on a platform bound to the fixed structure of a boarding or semi-boarding machine, and positioned in mutual contact by respective sides along a polygonal pathway defined by guiding means associated with said platform;

transporting in step said supporting member along said polygonal pathway, by the engagement with towing means acting independently, in suitable relation of phase, at each linear stretch of said polygonal pathway, so that in each step at least one position at the concurrence of two linear stretches of said polygonal pathway remains unoccupied;

arranging at least one of said supporting members for said shapes, on to which said textile articles to be treated are fed, in a halt position upstream from a semi-boarding station along a stretch of said polygonal pathway;

moving said supporting member, along said stretch of the polygonal pathway, so as to take said shapes inside said semi-boarding station, in order to accomplish the treatment of said textile articles;

transferring said supporting member, when the semi-boarding treatment is completed, to a station for the extraction of said textile articles, treated, from said shapes, wherein in the semi-boarding station a thermal boarding phase by means of pressurized steam is accomplished, inside at least one boarding chamber positioned along said linear stretch of the polygonal pathway, followed by a drying phase accomplished in a multiple drying station.

9. A method for treating textile articles, the method comprising the steps of:

feeding the textile articles to be treated on to shapes fitted on supporting members, sliding independently each other on a platform bound to the fixed structure of a boarding or semi-boarding machine, and positioned in mutual contact by respective sides along a polygonal pathway defined by guiding means associated with said platform;

transporting in step said supporting member along said polygonal pathway, by the engagement with towing means acting independently, in suitable relation of phase, at each linear stretch of said polygonal pathway, so that in each step at least one position at the concurrence of two linear stretches of said polygonal pathway remains unoccupied;

arranging at least one of said supporting members for said shapes, on to which said textile articles to be treated are fed, in a halt position upstream from a semi-boarding station along a stretch of said polygonal pathway;

moving said supporting member, along said stretch of the polygonal pathway, so as to take said shapes inside said semi-boarding station, in order to accomplish the treatment of said textile articles;

transferring said supporting member, when the semi-boarding treatment is completed, to a station for the extraction of said textile articles, treated, from said shapes, wherein in the semi-boarding station a thermal boarding phase by means of pressurized steam is accomplished, inside at least one boarding chamber positioned along said linear stretch of the polygonal pathway, followed by a drying phase accomplished in a multiple drying station, wherein, on leaving said multiple drying station, a pressing phase for said articles fed on to said shapes is accomplished.

10. A machine for treating textile articles, the machine comprising:

a loading station, where the textile articles to be treated are fed on to shapes fitted to supporting members, sliding independently each other on a platform bound to the fixed structure of the machine and positioned in mutual contact at respective sides along a polygonal pathway defined by guiding means associated with said platform;

in step towing means for said supporting members, acting independently, in suitable relation of phase, at each linear stretch of said polygonal pathway, so that in each step at least one position at the concurrence of two linear stretches of said polygonal pathway remains unoccupied;

a semi-boarding station positioned along a stretch of the said polygonal pathway and is able to receive said shapes fitted to said supporting members, in order to accomplish the treatment of said textile articles;

a station for extracting the said textile articles, treated, from said shapes;

a multiple semi-boarding station, provided with a set of pressing means, positioned along said stretch of the said polygonal pathway and able to receive simultaneously a corresponding set o shapes fitted to said supporting members.

11. A machine for treating textile articles, the machine comprising:

a loading station, where the textile articles to be treated are fed on to shapes fitted to supporting members, sliding independently each other on a platform bound to the fixed structure of the machine and positioned in mutual contact at respective sides along a polygonal pathway defined by guiding means associated with said platform;

in step towing means for said supporting members, acting independently, in suitable relation of phase, at each linear stretch of said polygonal pathway, so that in each step at least one position at the concurrence of two linear stretches of said polygonal pathway remains unoccupied;

a semi-boarding station positioned along a stretch of the said polygonal pathway and is able to receive said shapes fitted to said supporting members, in order to accomplish the treatment of said textile articles;

a station for extracting the said textile articles, treated, from said shapes;

in said semi-boarding station, a thermal boarding means through pressurized steam, inside at least one boarding chamber positioned along said linear stretch of polygonal pathway, followed by a multiple drying station.

12. A machine for treating textile articles, the machine comprising:

a loading station, where the textile articles to be treated are fed on to shapes fitted to supporting members, sliding independently each other on a platform bound to the fixed structure of the machine and positioned in mutual contact at respective sides along a polygonal pathway defined by guiding means associated with said platform;

in step towing means for said supporting members, acting independently, in suitable relation of phase, at each linear stretch of said polygonal pathway, so that in each step at least one position at the concurrence of two linear stretches of said polygonal pathway remains unoccupied;

a semi-boarding station positioned along a stretch of the said polygonal pathway and is able to receive said shapes fitted to said supporting members, in order to accomplish the treatment of said textile articles;

a station for extracting the said textile articles, treated, from said shapes;

in said semi-boarding station, a thermal boarding means through pressurized steam, inside at least one boarding chamber positioned along said linear stretch ofpolygonal pathway, followed by a multiple drying station;

a pressing station for said articles fed on to the said shapes.

13. A machine for treating textile articles, the machine comprising:

a loading station, where the textile articles to be treated are fed on to shapes fitted to supporting members, sliding independently each other on a platform bound to the fixed structure of the machine and positioned in mutual contact at respective sides along a polygonal pathway defined by guiding means associated with said platform;

in step towing means for said supporting members, acting independently, in suitable relation of phase, at each linear stretch of said polygonal pathway, so that in each step at least one position at the concurrence of two linear stretches of said polygonal pathway remains unoccupied;

a semi-boarding station positioned along a stretch of the said polygonal pathway and is able to receive said shapes fitted to said supporting members, in order to accomplish the treatment of said textile articles;

a station for extracting the said textile articles, treated, from said shapes;

in said semi-boarding station, a thermal boarding means through pressurized steam, inside at least one boarding chamber positioned along said linear stretch of polygonal pathway, followed by a multiple drying station, said thermal boarding means comprising a set of boarding chambers positioned along said stretch of the polygonal pathway, and able to receive simultaneously respective shapes fitted to said supporting members.

14. A machine for treating textile articles, the machine comprising:

a loading station, where the textile articles to be treated are fed on to shapes fitted to supporting members, sliding independently each other on a platform bound to the fixed structure of the machine and positioned in mutual contact at respective sides along a polygonal pathway defined by guiding means associated with said platform;

in step towing means for said supporting members, acting independently, in suitable relation of phase, at each linear stretch of said polygonal pathway, so that in each step at least one position at the concurrence of two linear stretches of said polygonal pathway remains unoccupied;

a semi-boarding station positioned along a stretch of the said polygonal pathway and is able to receive said shapes fitted to said supporting members, in order to accomplish the treatment of said textile articles;

a station for extracting the said textile articles, treated, from said shapes;

upstream from said semi-boarding station, a station for steaming the textile articles fed on to the said shapes.

* * * * *